US009027772B2

(12) United States Patent
Chen

(10) Patent No.: US 9,027,772 B2
(45) Date of Patent: May 12, 2015

(54) PORTABLE BARREL FOR CONTAINING BEVERAGE

(71) Applicant: Fang-Tzu Chen, Taichung (TW)

(72) Inventor: Fang-Tzu Chen, Taichung (TW)

( * ) Notice: Subject to any disclaimer, the term of this patent is extended or adjusted under 35 U.S.C. 154(b) by 0 days.

(21) Appl. No.: 14/339,537

(22) Filed: Jul. 24, 2014

(65) Prior Publication Data

US 2015/0034659 A1 Feb. 5, 2015

(30) Foreign Application Priority Data

Jul. 31, 2013 (TW) ..... 102214355 U

(51) Int. Cl.
*B65D 8/00* (2006.01)
*B65D 81/38* (2006.01)

(52) U.S. Cl.
CPC ..... *B65D 9/02* (2013.01); *B65D 81/3802* (2013.01)

(58) Field of Classification Search
CPC ..... B65D 7/045; B65D 1/20; B65D 1/16; B65D 11/06; B65D 81/3802; B65D 39/082; B65D 39/084; B65D 39/08; B65D 51/18; B65D 25/48; B65D 25/40; B65D 25/38; B65D 9/02
USPC ..... 220/4.05, 4.04, 601, 212, 259.4, 259.3, 220/256.1, 254.8, 254.1, 23.89, 23.87, 220/23.83; 222/568, 567, 566
See application file for complete search history.

(56) References Cited

U.S. PATENT DOCUMENTS 5,465,865 A * 11/1995 Coombes ..... 220/23.87

* cited by examiner

*Primary Examiner* — Robert J Hicks
(74) *Attorney, Agent, or Firm* — patenttm.us

(57) ABSTRACT

A portable barrel for containing beverage includes a barrel body, an inner tank, a barrel lid and an adjusting tray. The barrel body has a receiving recess. The inner tank is mounted in the receiving recess of the barrel body and has a tank body and a pouring cap mounted on the tank body. The barrel lid is mounted on the barrel body and covers the pouring cap of the inner tank. The adjusting tray is mounted on the barrel lid and connects with the inner tank. The barrel body and the barrel lid can keep the inner tank cooled for a long time. The adjusting tray can be rotated to move upward, such that a channel is formed between the pouring cap and the adjusting tray to easily pour the beverage out from the inner tank.

6 Claims, 8 Drawing Sheets

PORTABLE BARREL FOR CONTAINING BEVERAGE

BACKGROUND OF THE INVENTION

1. Field of the Invention

The present invention relates to a beverage container and more particularly to a portable barrel for containing beverage.

2. Description of Related Art

The conventional beverage container is made of metal to allow the beverage in the beverage container to be rapidly cooled down. If the conventional beverage container is put under direct exposure to the sun or in an outdoor area, the conventional metal beverage container also absorbs the heat of the sun very quickly and causes the temperature of the beverage to rise quickly.

To overcome the shortcomings of the conventional beverage container, the present invention provides a portable barrel for containing beverage to mitigate or obviate the aforementioned problems.

SUMMARY OF THE INVENTION

The main objective of the present invention is to provide a portable barrel for containing beverage including a barrel body, an inner tank, a barrel lid and an adjusting tray. The barrel body has a receiving recess. The inner tank is mounted in the receiving recess of the barrel body and has a tank body and a pouring cap mounted on the tank body. The barrel lid is mounted on the barrel body and covers the pouring cap of the inner tank. The adjusting tray is mounted on the barrel lid and connects with the inner tank.

The barrel body and the barrel lid can keep the inner tank cooled for a long time. The adjusting tray can be rotated to move upward, such that a channel is formed between the pouring cap and the adjusting tray to easily pour the beverage out from the inner tank.

Other objects, advantages, and novel features of the invention will become more apparent from the following detailed description when taken in conjunction with the accompanying drawing.

DETAILED DESCRIPTION OF PREFERRED EMBODIMENT

Figure 1:
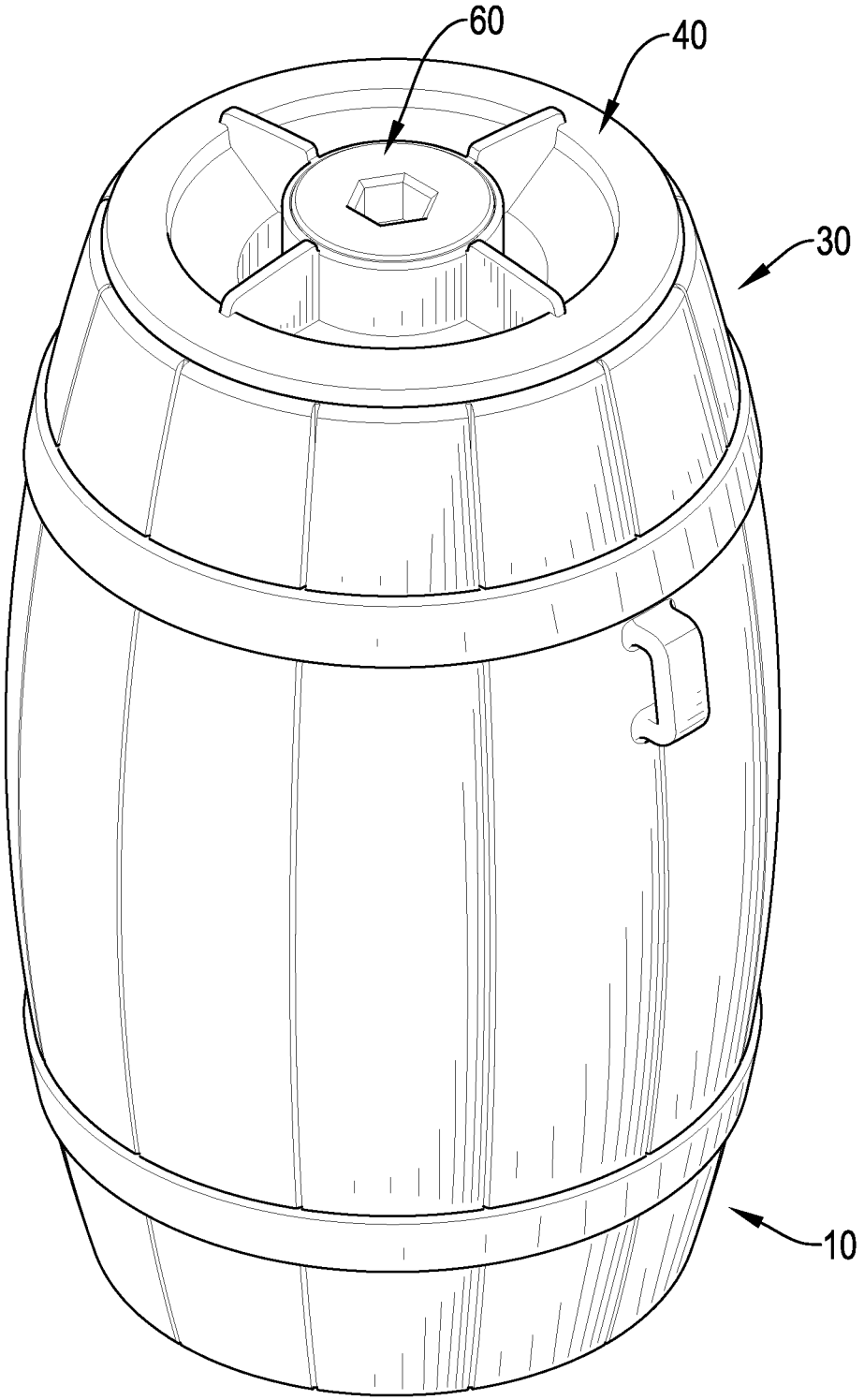
FIG. 1 is a perspective view of a portable barrel for containing beverage in accordance with the present invention.

With reference to FIGS. 1 to 4, a preferable embodiment of a portable barrel for containing beverage includes a barrel body 10, an inner tank 20, a barrel lid 30, an adjusting tray 40, a restricting unit 50 and a seal cover 60.

Figure 2:
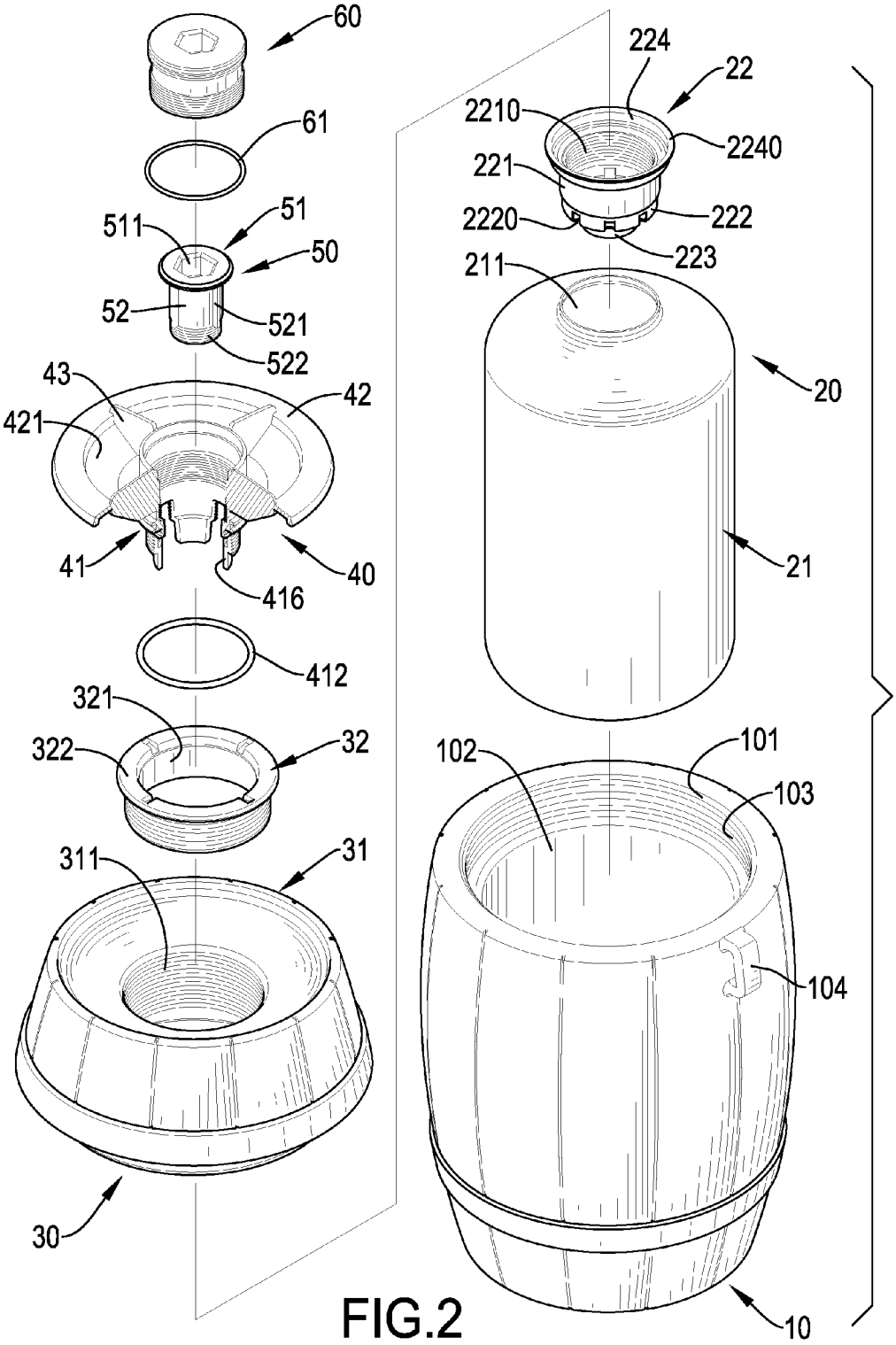
FIG. 2 is an exploded perspective view of the portable barrel for containing beverage in FIG. 1.

With reference to FIGS. 1 and 2, the barrel body 10 is round in cross-section, is made of heat-insulation material such as wood, foam plastics, etc. and has a barrel opening 101, a receiving recess 102, a threaded surface 103 and a handle 104. The barrel opening 101 is formed in a top of the barrel body 10, and the receiving recess 102 is formed in the barrel body 10 and communicates with the barrel opening 101. The threaded surface 103 is formed around an inner periphery of the receiving recess 102 and is located adjacent to the barrel opening 101. The handle 104 is mounted on an outer periphery of the barrel body 10 for portability.

Figure 3:
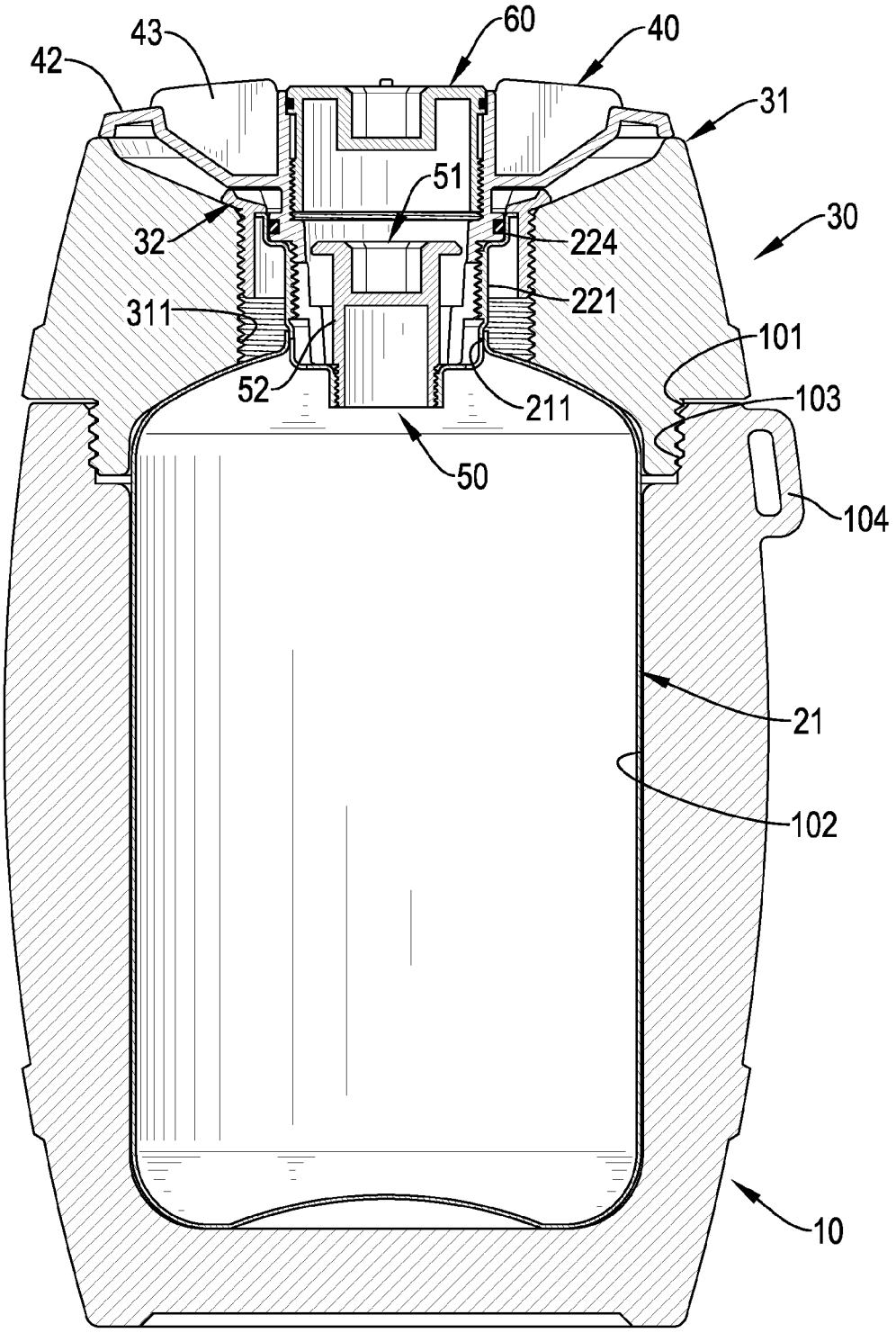
FIG. 3 is a cross-sectional front view of the portable barrel for containing beverage in FIG. 1.

With reference to FIGS. 2 and 3, the inner tank 20 is mounted in the barrel body 10 and includes a tank body 21 and a pouring cap 22. The tank body 21 is made of metal and has a tank opening 211 formed in a top of the tank body 21 for pouring beverage such as beer, soda water, soft drink, etc.

Figure 4:
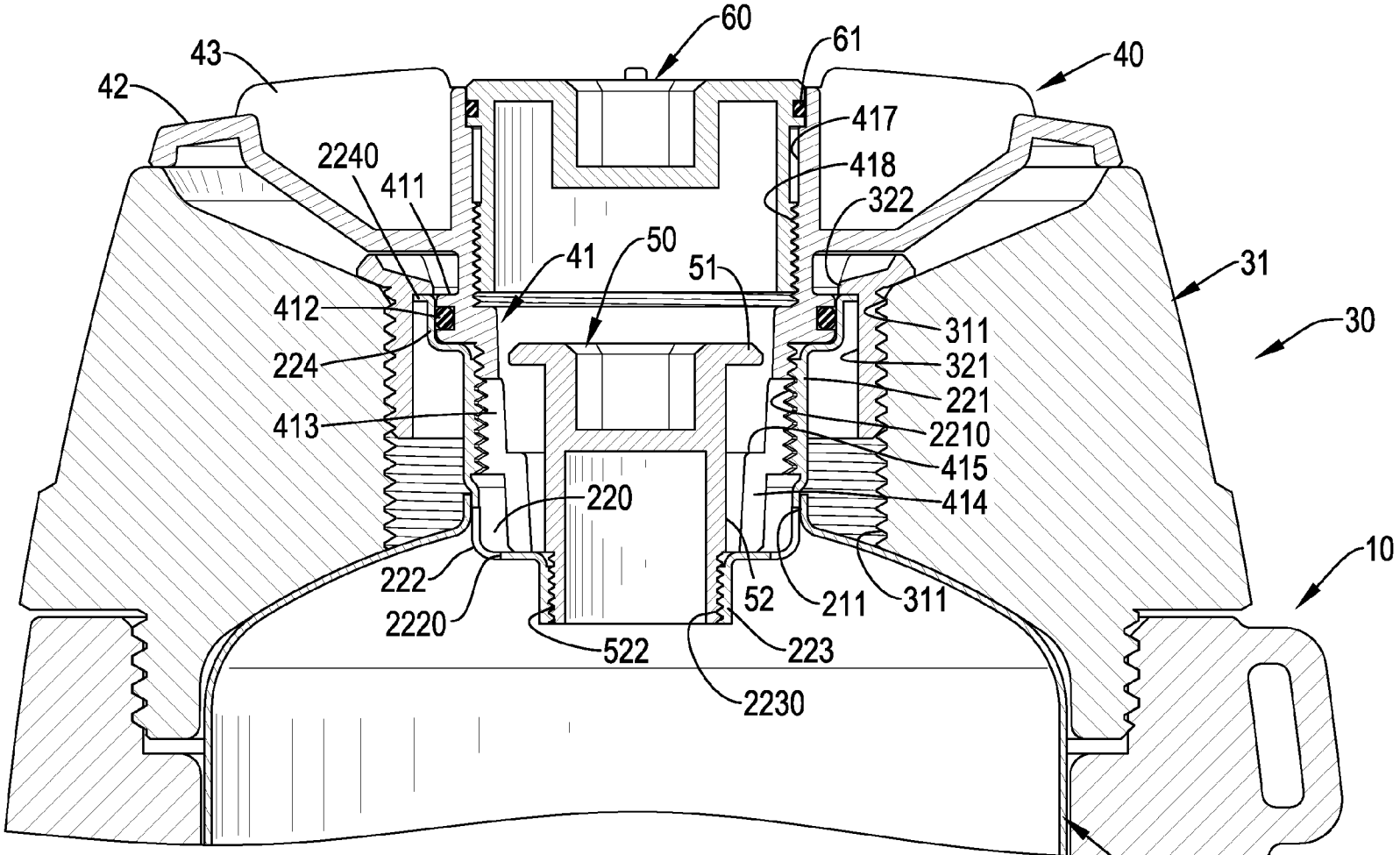
FIG. 4 is a partially enlarged cross-sectional front view of the portable barrel for containing beverage in FIG. 3.

With reference to FIGS. 2 and 4, the pouring cap 22 is mounted on the tank opening 211 and has a flow hole 220 longitudinally formed inside the pouring cap 22. Preferably, the pouring cap 22 further includes a barrel portion 221, a connecting portion 222, a neck portion 223 and an enlargement portion 224. The barrel portion 221 is cylindrical and has a bottom edge, a top edge, an inner periphery and a first threaded surface 2210 formed in the inner periphery of the barrel portion 221.

The connecting portion 222 is cylindrical, is connected around the bottom edge of the barrel portion 221, and has a bottom corner, a bottom edge and multiple water outlets 2220 formed around the bottom corner of the connecting portion 222. A diameter of the connecting portion 222 is smaller than a diameter of the barrel portion 221. The connecting portion 222 of the pouring cap 22 is mounted in the tank opening 211.

The neck portion 223 is cylindrical, is connected around the bottom edge of the connecting portion 222, and has an inner periphery and a second threaded surface 2230 protruding from the inner periphery of the neck portion 223 and extending downward into the tank body 21. A diameter of the neck portion 223 is smaller than the diameter of the connecting portion 222.

The enlargement portion 224 is connected around the top edge of the barrel portion 221 and has a top edge and an abutment edge 2240 horizontally protruding around the top edge of the enlargement portion 224.

With reference to FIGS. 3 and 4, the barrel lid 30 is mounted on the barrel body 10 and has a lid body 31 and an engaging ring 32. The lid body 31 is detachably mounted on the threaded surface 103 of the barrel body 10, is made of heat-insulation material, and has an assembling hole 311 formed through the center of the lid body 31 and being a screw hole.

The engaging ring 32 is screwed with the assembling hole 311 and has a through hole 321 and a ring flange 322. The through hole 321 is formed at the center of the engaging ring 32 and has an inner periphery. The ring flange 322 protrudes from the inner periphery of the through hole 321 and abuts the abutment edge 2240 to ensure the pouring cap 22 is fixed with the tank body 21. An inner diameter of the ring flange 322 is equal to an inner diameter of the enlargement portion 224.

The adjusting tray 40 is mounted on the barrel lid 30, is connected with the pouring cap 22, and includes an assembling portion 41, a tray portion 42 and multiple pushing boards 43. The assembling portion 41 is cylindrically tapered and has a leakproof portion 411, a seal ring 412, a screwing portion 413, a tubular portion 414, an abutment flange 415, multiple notches 416, a mounting hole 417 and a screwing surface 418.

The leakproof portion 411 protrudes from a middle segment of the assembling portion 41 and has a bottom edge and an annular recess 4110 formed around an outer periphery of the leakproof portion 411. An outer diameter of the leakproof portion 411 is equal to an inner diameter of the enlargement portion 224. The seal ring 412 is mounted in the annular recess 4110.

The screwing portion 413 is connected around the bottom edge of the leakproof portion 411 and has an inner periphery, an outer periphery and multiple screw threads formed around the outer periphery of the screwing portion 413. The screwing portion 413 of the adjusting tray 40 is screwed with the first threaded surface 2210 of the pouring cap 22.

The tubular portion 414 protrudes from the inner periphery of the screwing portion 413 and extends downward. The abutment flange 415 is formed on the inner periphery of the screwing portion 413 and located adjacent to the tubular portion 414. The notches 416 are formed around a bottom side of tubular portion 414 at intervals. The mounting hole 417 is formed longitudinally through the assembling portion 41. The screwing surface 418 is formed inside of the mounting hole 417 and located adjacent to the leakproof portion 411.

The tray portion 42 is integratedly formed around a top segment of the assembling portion 41, is located above the leakproof portion 411, and has a tray recess 421 formed around the assembling portion 41. The pushing boards 43 are arranged around the tray recess 421 at equal intervals and are connected with the tray portion 42 and the assembling portion 41.

The adjusting tray 40 can be rotated clockwise or counterclockwise by pushing the pushing boards 43 to be screwed with the pouring cap 22 until the leakproof portion 411 and the seal ring 412 abut the enlargement portion 224 of the pouring cap 22.

With reference to FIGS. 3 and 4, the restricting unit 50 is mounted on the pouring cap 22 via the mounting hole 417 of the adjusting tray 40 and has a head portion 51 and a column portion 52 connected with a bottom of the head portion 51. The head portion 51 is a round plate, is located above the abutment flange, 415 and has an outer diameter and a socket 511 formed at a center of the head portion 51. The outer diameter of the head portion 51 is larger than an inner diameter of the abutment flange 415. The column portion 52 has an inner periphery, a bottom segment, multiple ribs 521 formed around the inner periphery, and a threaded surface 522 arranged around the bottom segment. The threaded surface 522 is screwed with the second threaded surface 2230 of the neck portion 223.

With reference to FIGS. 2 and 4, the seal cover 60 is detachably mounted on the adjusting tray 40. The seal cover 60 is mounted through the mounting hole 417, is screwed with the screwing surface 418, and has a seal ring 61 mounted around the seal cover 60 and abutting the mounting hole 417. The seal cover 60 can prevent the beverage from pouring out from the mounting hole 417 of the adjusting tray 40.

Figure 5:
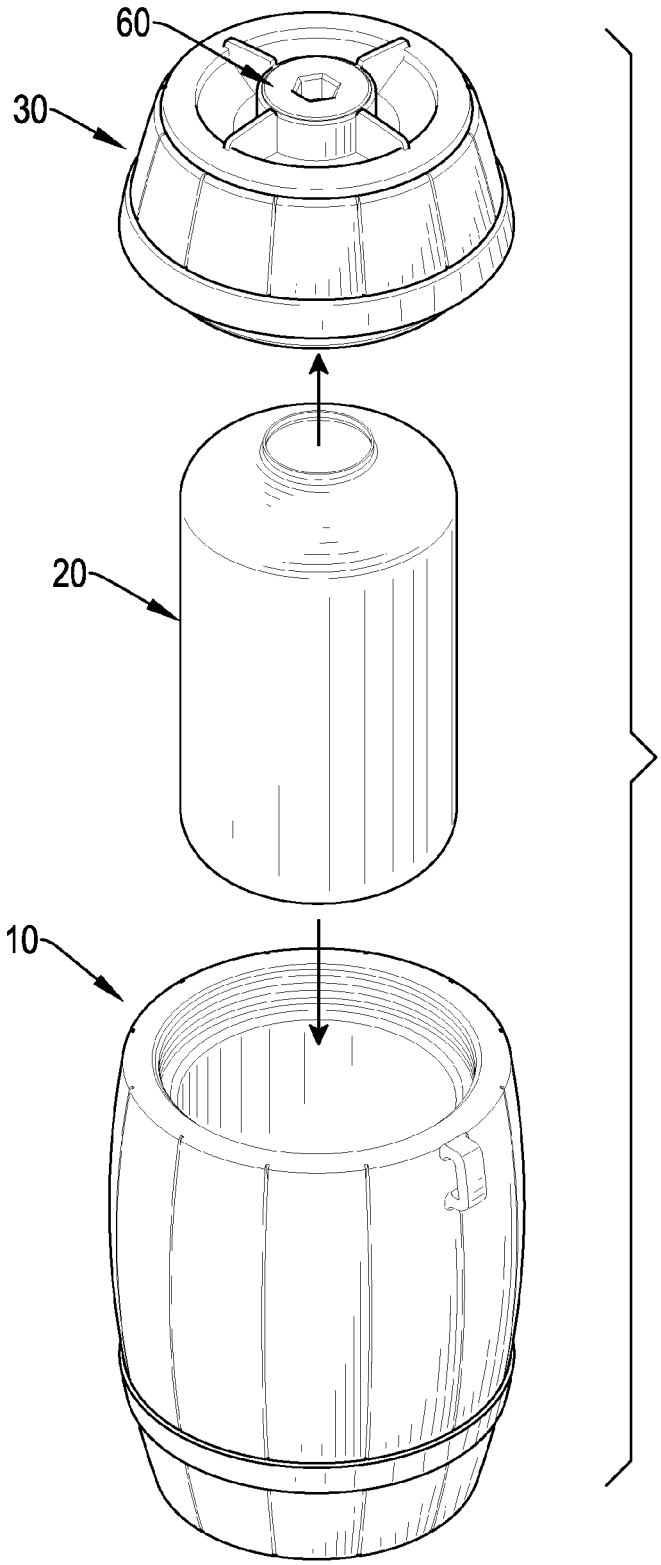
FIG. 5 is an exploded perspective view of the portable barrel for containing beverage in FIG. 1.
Figure 6:
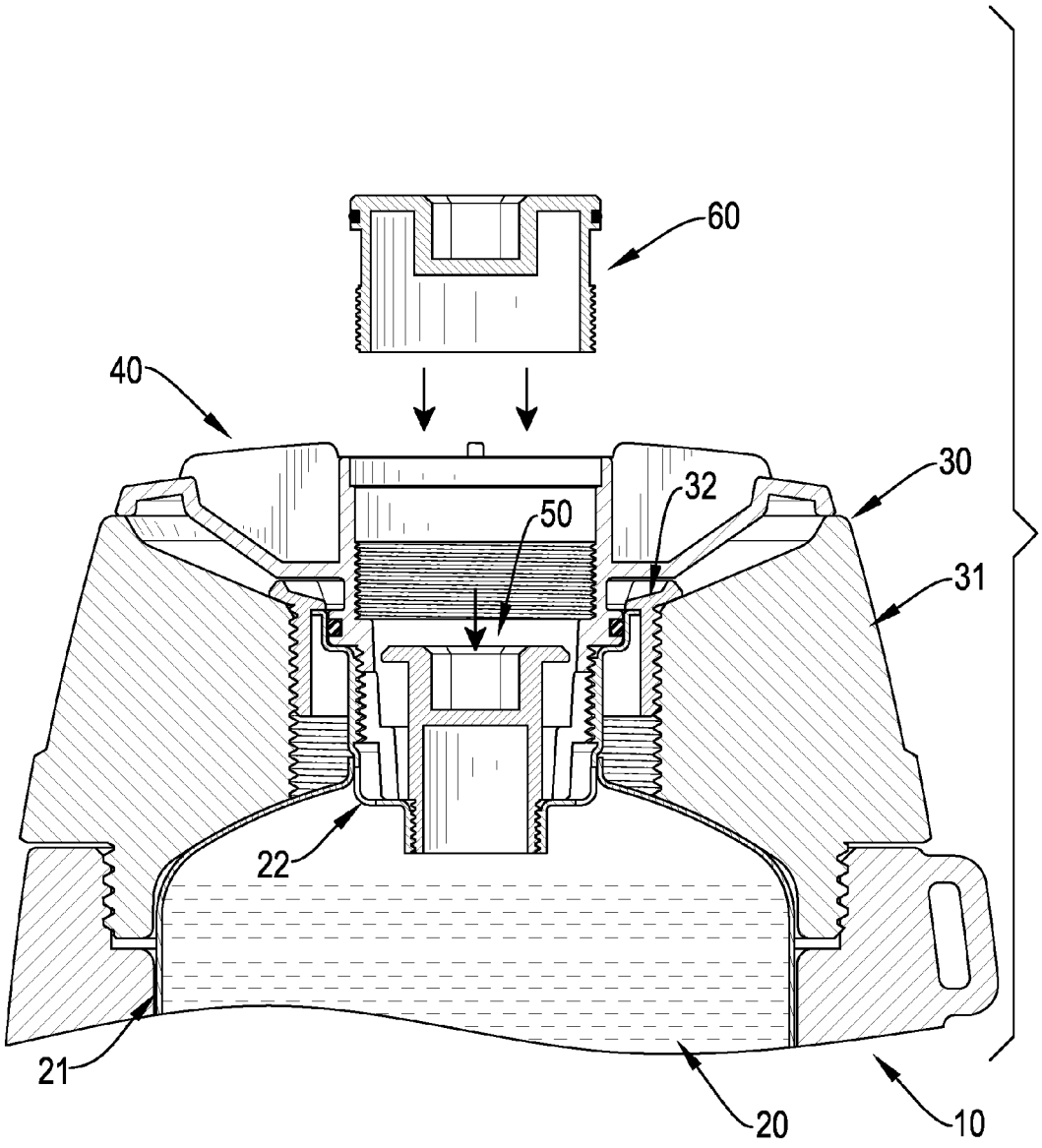
FIG. 6 is an enlarged operational cross-sectional front view of the portable barrel for containing beverage in FIG. 1, showing a seal cover being mounted in a barrel body.

With reference to FIGS. 5 and 6, in an assembling process, the inner tank 20 is placed into the receiving recess 102 of the barrel body 10 and beverage can be poured into the inner tank 20 via the pouring cap 22. After the inner tank 20 is placed, the barrel lid 30 is covered on the barrel body 10 and abuts the pouring cap 22. The adjusting tray 40 is mounted in the barrel lid 30 and abuts the engaging ring 32. Finally, the restricting unit 50 is mounted on the pouring cap 22 and the seal cover 60 is mounted on the adjusting tray 40 to finish the assembling process.

Because the barrel body 10 and the barrel lid 30 are made of heat-insulation material and the inner tank 20 is made of metal, the beverage stored inside the inner tank 20 can keep cooled for a long time. In an indoor area, the inner tank 20 can be stored in a refrigerator to keep cooled. In an outdoor area, the inner tank 20 can be held in the barrel body 10 to insulate high temperature from outdoor area and to prolong the preservation time. The inner tank 20 can also be refilled whenever needed, be removed from the barrel body 10, and be stored in a refrigerator.

Figure 7:
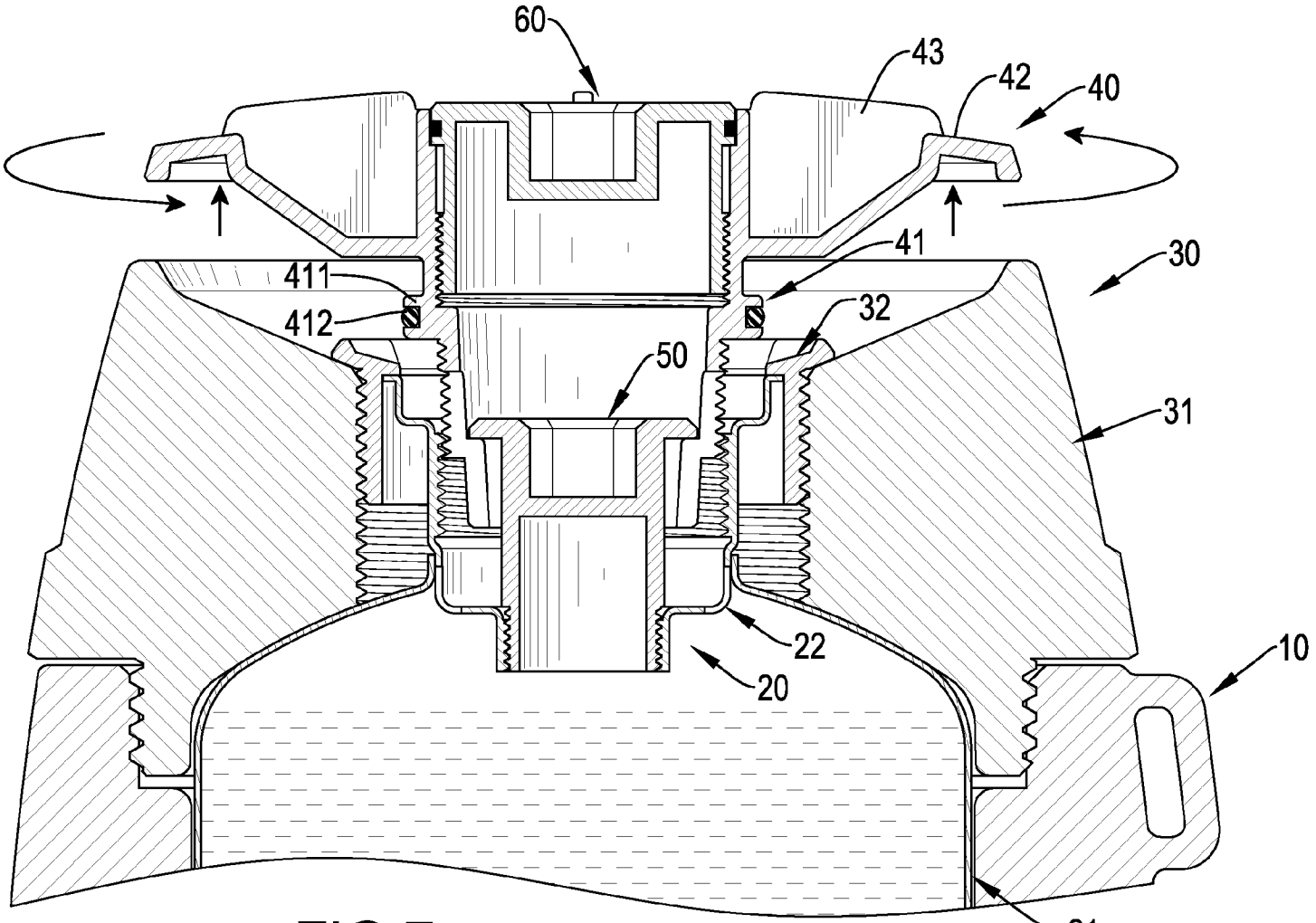
FIG. 7 is an operational cross-sectional front view of the portable barrel for containing beverage in FIG. 6, showing an adjusting tray being rotated.
Figure 8:
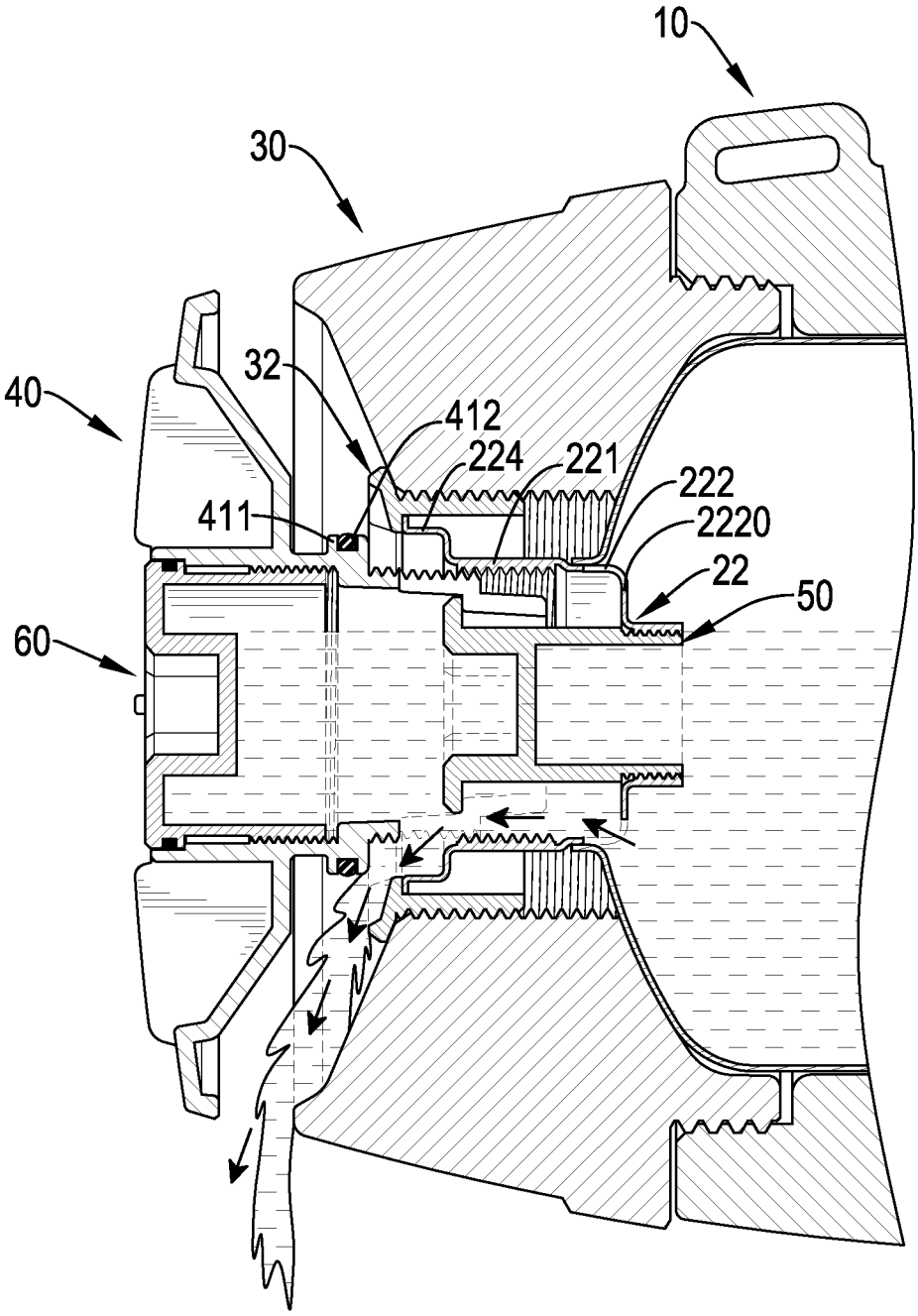
FIG. 8 is an operational cross-sectional front view of the portable barrel for containing beverage in FIG. 7, showing beverage being poured out from the barrel body.

With reference to FIGS. 7 and 8, a user can rotate the adjusting tray 40 upward to separate the leakproof portion 411 and the seal ring 412 from the enlargement portion 224 of the pouring cap 22. Then, the user can tilt the barrel body 10 to pour the beverage out from the flow hole 220 of the inner tank 20 via the water outlets 2220 and the notches 416. The adjusting tray 40 can keep rotating upward until the restricting unit 50 blocks the abutment flange 415 of the adjusting tray 40 to stop the adjusting tray 40 from moving upward, so as to prevent the adjusting tray 40 from being separated from the pouring cap 22.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A portable barrel comprising:

a barrel body made of heat-insulation material and having
- a barrel opening formed in a top of the barrel body; and
- a receiving recess communicating with the barrel opening;

an inner tank mounted in the barrel body and including
- a tank body made of metal and having a tank opening formed in a top of the tank body; and
- a pouring cap mounted on the tank opening and having a flow hole longitudinally formed inside the pouring cap and multiple water outlets formed around a bottom corner of the pouring cap;

a barrel lid mounted on the barrel body and having
- a lid body detachably mounted on the barrel opening of the barrel body, made of heat-insulation material and having an assembling hole formed through a center of the lid body; and
- an engaging ring mounted in the assembling hole and having
  - a through hole formed at a center of the engaging ring and
  - a ring flange protruding from an inner periphery of the through hole and abutting the pouring cap; and an adjusting tray mounted on the barrel lid, connected with the pouring cap and including an assembling portion being cylindrical and having
- a leakproof portion protruding from the assembling portion and abutting the pouring cap; and
- a seal ring mounted on the leakproof portion;

a tray portion integratedly formed around the assembling portion, located above the leakproof portion, and having
- a tray recess formed around the assembling portion; and multiple pushing boards arranged around the tray recess at equal intervals and connected with the tray portion and the assembling portion.

2. The portable barrel as claimed in claim 1, wherein the assembling portion has a mounting hole formed longitudinally through the assembling portion, and the portable barrel further includes a seal cover detachably mounted on the mounting hole of the adjusting tray.

3. The portable barrel as claimed in claim 2, wherein the pouring cap further includes:

a barrel portion being cylindrical and having a bottom edge, a connecting portion being cylindrical, connected around the bottom edge of the barrel portion, and having a bottom corner and a bottom edge, and the connecting portion has a diameter smaller than a diameter of the barrel portion; and a neck portion being cylindrical and connected around the bottom edge of the connecting portion.

4. The portable barrel as claimed in claim 3, wherein the portable barrel further includes a restricting unit mounted on the pouring cap and having a head portion and a column portion connected with a bottom of the head portion;

the assembling portion of the adjusting tray has a screwing portion connected around a bottom edge of the leakproof portion and a tubular portion protruding from an inner periphery of the screwing portion and extending downward;

an abutment flange is formed on the inner periphery of the screwing portion and is located adjacent to the tubular portion, and multiple notches are formed around a bottom side of the tubular portion at intervals; and the head portion is located above the abutment flange and has an outer diameter larger than an inner diameter of the abutment flange.

5. The portable barrel as claimed in claim 4, wherein the pouring cap further has an enlargement portion connected around a top edge of the barrel portion and having an abutment edge horizontally protruding around a top edge of the enlargement portion;

the ring flange abuts the abutment edge of the pouring cap; and an inner diameter of the ring flange is equal to an inner diameter of the enlargement portion.

6. The portable barrel as claimed in claim 5, wherein the adjusting tray has a screwing surface formed inside of the mounting hole and located adjacent to the leakproof portion; and the seal cover is screwed with the screwing surface and has a seal ring mounted around the seal cover and abutting the mounting hole.

* * * * *